US007264448B2

(12) United States Patent
Garner

(10) Patent No.: US 7,264,448 B2
(45) Date of Patent: Sep. 4, 2007

(54) REMOTELY ACCESSIBLE LOCKING SYSTEM FOR TURBINE BLADES

(75) Inventor: Chad Marcus Garner, Orlando, FL (US)

(73) Assignee: Siemens Power Corporation, Inc., Orlando, FL (US)

( * ) Notice: Subject to any disclaimer, the term of this patent is extended or adjusted under 35 U.S.C. 154(b) by 371 days.

(21) Appl. No.: 10/959,532

(22) Filed: Oct. 6, 2004

(65) Prior Publication Data

US 2006/0073021 A1 Apr. 6, 2006

(51) Int. Cl.
*B63H 1/20* (2006.01)

(52) U.S. Cl. ..... 416/212 R; 416/214 R

(58) Field of Classification Search ..... 416/212 R, 416/213 R, 193 A, 214 R, 219 R
See application file for complete search history.

(56) References Cited

U.S. PATENT DOCUMENTS 2,801,074 A 7/1957 Brown
2,971,744 A 2/1961 Szydlowski
3,266,770 A 8/1966 Harlow
3,395,891 A 8/1968 Burge et al.
4,021,138 A 5/1977 Scalzo et al.
4,747,321 A * 5/1988 Hannel ..... 74/440
4,778,342 A 10/1988 Conlow
5,152,797 A * 10/1992 Luckman et al. ..... 623/20.16
5,727,927 A 3/1998 Luxenburger
5,993,160 A 11/1999 Bouchard et al.
7,036,473 B1 * 5/2006 Goracy ..... 123/90.27

* cited by examiner

*Primary Examiner*—Hoang Nguyen

(57) ABSTRACT

Embodiments of the invention relate to an axial locking system for a row of blades in a turbine engine. While achieving the desired axial restraint, the system is configured to allow remote manipulation of the locking system. For example, a locking system provided on the upstream side of a row of blades can be accessed from the downstream side of the blades. Such a system can provide significant cost savings during the installation and removal of the blades. In one embodiment, the axial locking system can include a plate with a rotatable cam. Cooperating with the disc, the cam can be rotated to bring the radially outer end of the plate into locking engagement with the turbine blades. The cam can be manipulated from the other side of the disc by a tool extending through a passage formed between the disc and the blade root.

21 Claims, 7 Drawing Sheets

REMOTELY ACCESSIBLE LOCKING SYSTEM FOR TURBINE BLADES

FIELD OF THE INVENTION

The invention relates in general to turbine engines and, more particularly, to a system and method for facilitating the installation and removal of turbine blades.

BACKGROUND OF THE INVENTION

The turbine section of a turbine engine is enclosed within an outer casing. A blade ring or vane carrier is disposed within the outer casing. One or more rows of stationary airfoils, known as vanes, can be attached to and extend radially inward from the inner periphery of the vane carrier. Depending on the engine, there may be a single vane carrier hosting every row of vanes, or there can be multiple vane carriers with each hosting at least one row of vanes.

The rows of vanes alternate with rows of rotating airfoils, commonly referred to as blades. Each row of blades is formed by a plurality of blades provided on a rotor disc such that the blades are arrayed about the periphery of the rotor disc. The individual blades include an airfoil, a platform and a root. The blade root is held in a slot provided in the disc. While the blades are held circumferentially and radially by their engagement with the slot and with the adjacent blades, such engagements do not sufficiently restrain the blades in the axial direction. Accordingly, some turbine engines include a locking system to axially retain the blades.

FIG. 1 shows a known system 10 for axially locking a blade 11. More specifically, the system 10 includes a plate 12. The plate 12 has a radially outer end 14 and a radially inner end 16. At its radially outer end 14, the plate 12 engages a slot 18 provided in the platform 20 of the blade 11. The plate 12 is secured near its radially inner end 16 to the rotor disc 22 by a bolt 23. Such locking hardware is provided on the axial upstream side 24 and the axial downstream side 26 of the disc 22 so as to substantially restrict movement of the blade 11 in the axial direction. A plurality of plates 12 can be provided about each side 24, 26 of the disc to axially restrain the entire row of blades 11.

Though successful in achieving the desired axial restraint, the prior locking hardware 10 can hinder the installation and/or removal of one or more blades 11 from the disc 22. For example, turbine inspections have revealed damage to only the last row turbine blades in some instances. The locking hardware 10 on the axial downstream side 26 of the disc 22 can be accessed and removed through the engine exhaust (not shown); however, the locking hardware 10 on the axial upstream side 24 of the disc 22 is not readily accessible. In order to remove the axial upstream locking hardware 10 and the blades 11 themselves, the outer casing (not shown) and the vane carrier (not shown) surrounding the last row of blades must be removed to gain access to the axial upstream locking hardware 10, particularly the bolt 23.

The removal of the outer casing and the vane carrier can require, among other things, the mobilization of a crane, special tooling, and work crews for additional work shifts. The expenses associated with such an undertaking can be considerable. Moreover, such a project can result in extended outages, and some service contracts can provide for significant liquidated damages or other penalties for extended outages. Thus, there is a need for an turbine blade axial locking system that can facilitate the installation and removal of turbine blades.

SUMMARY OF THE INVENTION

Embodiments of the invention are directed to a locking plate assembly for axially restraining a turbine blade. The assembly includes a plate, a cam and a locking member. The plate has a first side and a second side. An opening extends through the plate from the first side to the second side.

The cam has a cam body and a cam shaft extending from the cam body. The cam body is disposed on the first side of the plate. The cam is rotatably connected to the plate by engagement between the cam shaft and the opening. In one embodiment, the opening in the plate can be threaded and the cam shaft can be threaded; thus, the cam body can be rotataby connected to the plate by threaded engagement between the cam shaft and the opening.

The cam shaft defines the axis of rotation of the cam body. The axis of rotation is offset from the center of the cam body. A locking member is disposed between the cam body and the plate so as to substantially impede undesired movement of the cam.

A portion of the cam is accessible from the second side of the plate. In one embodiment, the end of the cam shaft can be the accessible portion of the cam. The accessible portion of the cam is adapted for engagement by a tool. Accordingly, the accessible portion of the cam can include, for example, a flat head slot, a Phillips head recess, a socket head recess, a hex head recess, an Allen head recess, or a protrusion. By turning the accessible portion of the cam, using the tool or otherwise, the cam body rotates about its axis of rotation.

Embodiments of the invention further relate to a turbine blade axial locking system. The system includes a turbine blade, which can include at least a platform portion and a root portion. The system also includes a disc that has an axial upstream side and an axial downstream side. The disc is adapted to receive at least a portion of the turbine blade. When the blade is received in the disc, a substantially axial passage is formed between the blade and the disc. The passage is open at both of its ends.

The system further includes a plate and a cam. The plate has an inner face and an outer face. The plate is positioned on one side of the disc such that the inner face of the plate faces toward the disc. The cam includes at least a cam body provided on the outer face of the plate. The cam body is rotatably connected to the plate. In one embodiment a threaded cam shaft can extend from the cam body, and the plate can include a threaded opening extending from the outer face toward the inner face. In such case, the cam shaft can threadably engage the opening so as to allow the cam body to rotate relative to the plate. The axis of rotation of the cam body is offset from the center of the cam body. In one embodiment, the cam body can have a rounded portion and a flat portion; the axis of rotation of the cam body can be located closer to the rounded portion than the flat portion of the cam body.

The cam body engages a portion of the disc such that the plate is movable into and out of locking engagement with the blade. When the plate lockingly engages the blade, a portion of the opposite end of the plate can abut a portion of the disc. In one embodiment, the plate can lockingly engage the platform portion of the blade. In such case, a slot can be provided in the platform portion for receiving the plate. Further, a locking member can be disposed between the plate and the cam body so as to impede unwanted movement of the cam.

For all travel positions of the cam body, a sufficient portion of the cam is accessible from the inner face of the plate within an area defined by superimposing the passage onto the inner face of the plate. The accessible portion of the cam can be adapted for engagement by a tool. The accessible portion of the cam can include a flat head slot, a Phillips head recess, a socket head recess, a hex head recess, an Allen head recess, or a protrusion. The cam shaft can extend away from the cam body to an end. In one embodiment, the end of the cam shaft can be the accessible portion of the cam. Accordingly, the end of the cam shaft can be adapted for engagement by a tool.

The above described system allows an elongated tool to be inserted into the passage from the side of the disc opposite the side on which the plate is positioned. The tool can engage the accessible portion of the cam so as to rotate the cam body.

Further embodiments of the invention are directed to a method of accessing turbine blades. A turbine blade and a disc are provided. The disc has an axial upstream side and an axial downstream side. The disc is adapted for receiving at least a portion of the turbine blade such that a substantially axial passage is formed between the blade and the disc.

A plate and a cam are also provided. The plate has an inner face and an outer face. The plate is positioned on one side of the disc such that the inner face of the plate faces the disc. The cam includes at least a cam body that is disposed on the outer face of the plate. The cam body is rotatably connected to the plate. The cam body has an axis of rotation that is offset from the center of the cam body. The cam body engages a portion of the disc such that the plate is movable into and out of locking engagement with the blade. For all travel positions of the cam body, a sufficient portion of the cam is accessible from the inner face of the plate within an area defined by superimposing the passage onto the inner face of the plate.

According to embodiments of the invention, an elongated tool is inserted into the passage from the side of the disc opposite the side on which the plate is positioned. The accessible portion of the cam is engaged by the tool. The tool can be used to rotate the cam so as to move the plate into locking engagement with the blade. Alternatively, the tool can be used to rotate the cam so as to move the plate out of locking engagement with the blade. The plate can be held while the cam is being rotated. The blade can be removed by moving the blade axially toward the side of the disc opposite the side on which the plate is positioned.

DETAILED DESCRIPTION OF EMBODIMENTS OF THE INVENTION

Embodiments of the present invention address the drawbacks of prior axial locking systems for turbine engines. According to embodiments of the invention, an axial locking system can be configured to allow remote manipulation of the system from an opposite side of the rotor disc. Embodiments of the invention will be explained in the context of one possible system, but the detailed description is intended only as exemplary. Embodiments of the invention are shown in FIGS. 2-6, but the present invention is not limited to the illustrated structure or application.

Figure 2:
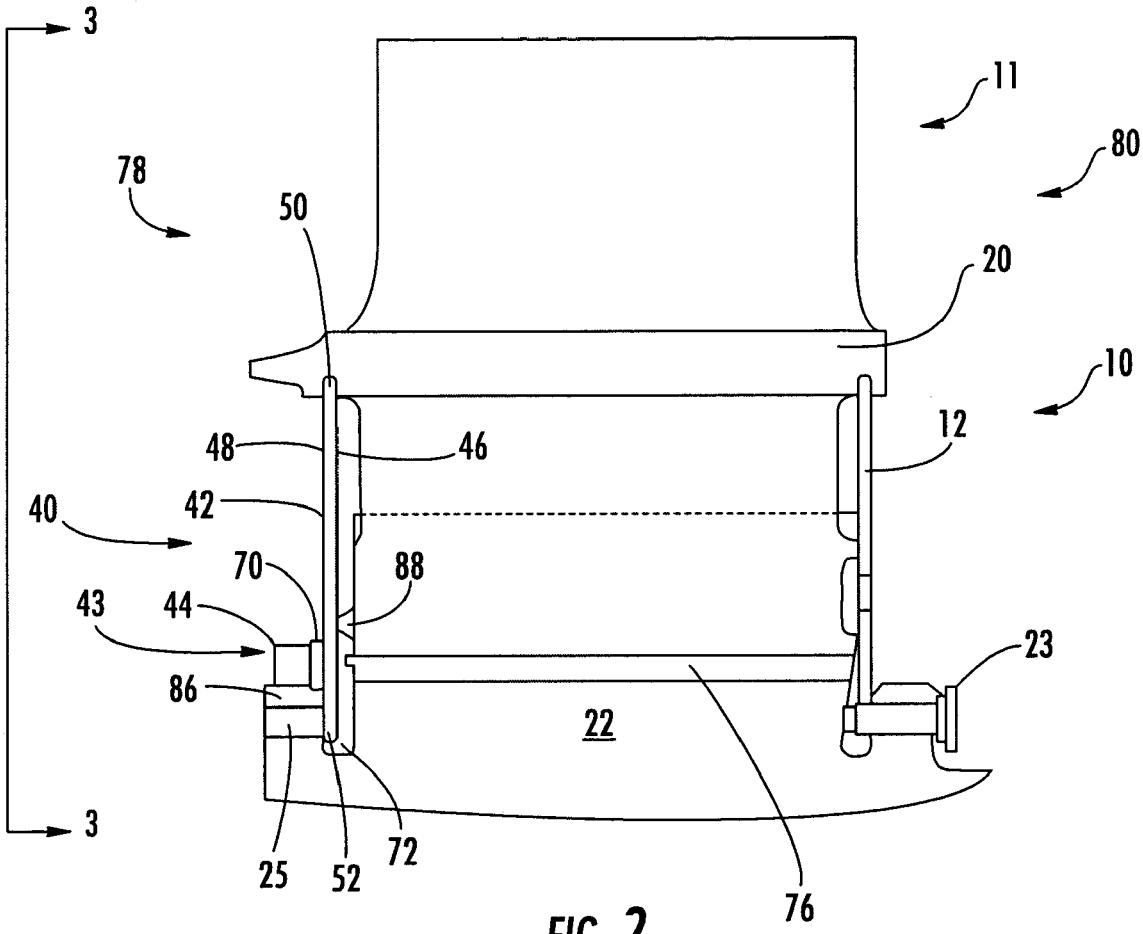
FIG. 2 is a cross-sectional view of a locking system according to embodiments of the invention provided on the axial upstream side of a disc.

Referring to FIG. 2, an axial locking system 40 according to embodiments of the invention can include a plate 42 with a rotatable cam 43. The plate 42 can have an inside face 46, which faces the blades 11 and disc 22 when installed, and an outside face 48, which faces away from the blades 11 and disc 22 when installed. The plate 42 has a radially outer end 50 and a radially inner end 52. The terms "radially inner" and "radially outer" refer to the operational position of each end relative to the turbine. The plate 42 further includes peripheral ends 54 (see FIG. 4). As noted earlier, a series of plates can be provided about each axial side 24, 26 of the disc 22. Thus, the peripheral ends 54 can be configured to engage the peripheral ends of adjacent plates. In one embodiment, shown in FIG. 4, the peripheral ends 54 can be angled so as to overlappingly engage the angled peripheral ends of adjacent plates.

The plate 42 can be made of any of a number of materials, including stainless steel. The plate 42 can have any of a number of shapes and conformations, and embodiments of the invention are not limited to the plate 42 shown in FIGS. 2-6. The plate 42 can be substantially flat. The plate 42 can include curves bends or other features. The plate 42 can be made in any of a number of ways including conventional machining.

Figure 4:
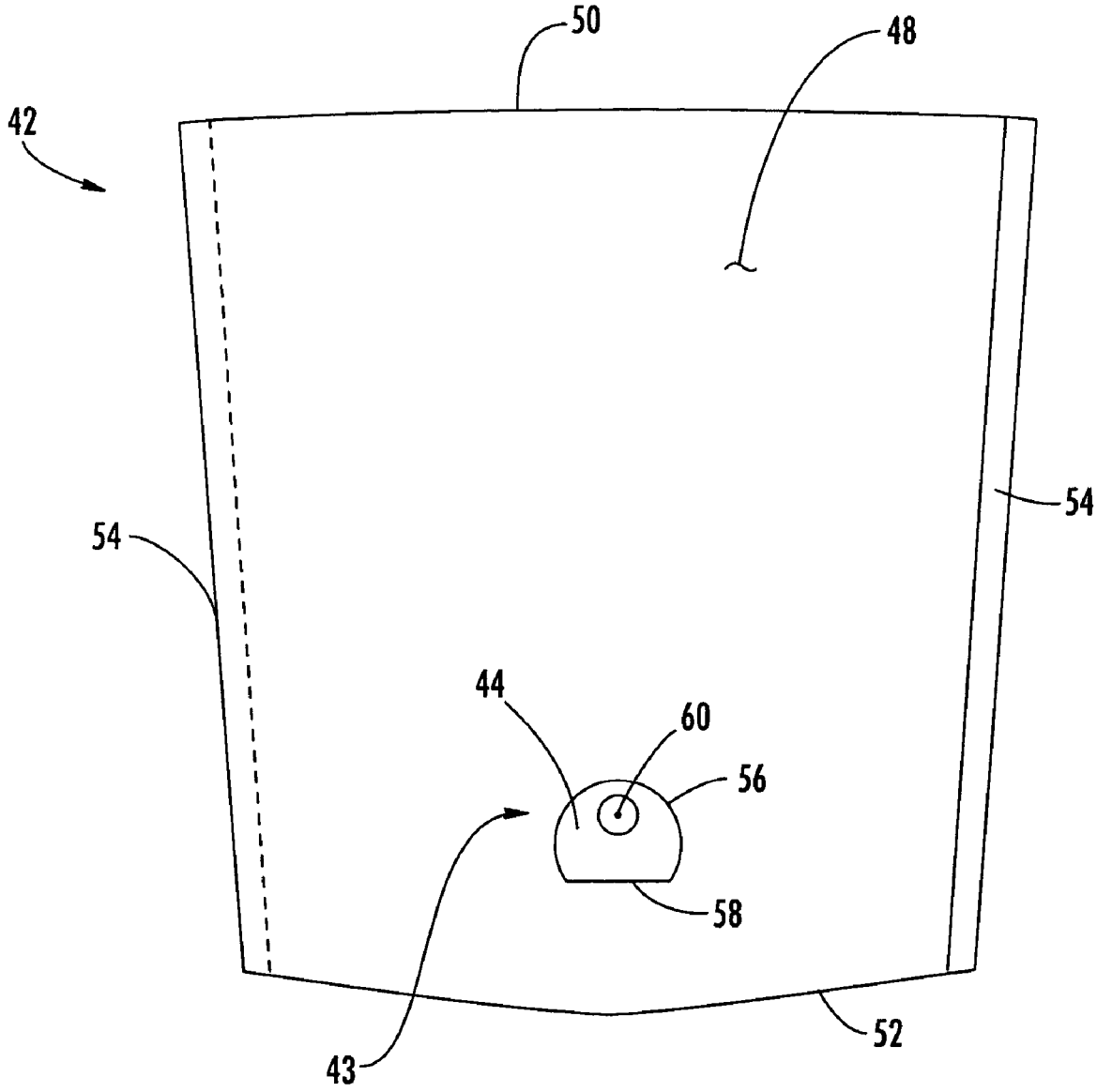
FIG. 4 is a front view of an axial locking plate assembly according to embodiments of the invention.

The cam 43 can include a cam body 44. The cam body 44 can be provided on the outside face 48 of the plate 42. Preferably, the cam body 44 includes a rounded portion 56 and a flat portion 58. The rounded portion 56 can be, for example, substantially circular, oval or polygonal. However, the cam body 44 can have other conformations. The axis of rotation 60 of the cam body 44 is offset from the true center of the cam body 44. As shown in FIG. 4, the axis of rotation 60 of the cam body 44 can be located closer to the rounded portion 56 than it is to the flat portion 58. While numerous locations are possible, the factors affecting the location of the cam body 44 on the plate 42 will be discussed later. The cam body 44 can be made of any of a number of materials including stainless steel. Preferably, the cam body 44 is made of the same material as the plate 42.

Again, the cam body 44 is connected to the plate 42 so as to be rotatable. In one embodiment, the cam body 44 can rotate a full 180 degrees in either direction about the axis of rotation 60. In some instances, the range of motion of the cam body 44 may be restricted to less than 180 degrees in at least one direction about the axis of rotation 60. There are a variety of ways that the cam 43 can be operatively associated with the plate 42 so as to permit rotation of the cam body 44. For example, the cam 43 can include a cam shaft 62 extending from the cam body 44. In such case, the cam shaft 62 can define the axis of rotation 60 of the cam body 44. Ideally, the cam shaft 62 extends at substantially 90 degrees from the cam body 44, but other angles are possible. The cam shaft 62 and the cam body 44 can be unitary, or the cam shaft 62 can be integrated with the cam body 44 in various ways including welding, brazing, adhesives, and mechanical engagement, just to name a few possibilities. In one embodiment, the shaft 62 can include external threads. The threaded shaft 62 can be received within a threaded opening 64 extending through the plate 42 from the outside face 48 to the inside face 46. The threaded engagement between the cam shaft 62 and the opening 64 permits rotation of the cam body 44 relative to the plate 42. Again, this is only one of many possible constructions for providing a rotatable cam body 44 on the plate 42, as one skilled in the art will appreciate.

Regardless of the specific manner in which the cam body 44 is rotatably associated with the plate 42, the cam 43 can be manipulated from the inside face 46 of the plate 42. There are a number of ways such remote manipulation can be achieved according to embodiments of the invention. One example will be discussed in connection with the above described cam 43 having cam body 44 and a threaded cam shaft 62, but the invention is not limited to this example.

The shaft 62 can terminate at an end 66. The end 66 of the shaft 62 can be flush with the inside face 46 of the plate 42. Alternatively, the end 66 of the shaft 62 may extend beyond or may be recessed from the inside face 46 of the plate 42. The end 66 of the shaft 62 can be adapted for engagement by a tool so that the shaft 62 and the cam body 44 connected to the shaft 62 can be turned. The phrase "end of the shaft" is intended to describe the actual end of the shaft 62 as well as a portion of the shaft near the actual end. In one embodiment, the end 66 of the shaft 62 can provide a slot 68 for engagement by a tool, such as a flat head screwdriver. The end 66 of the shaft 62 can have a recess shaped for engagement by various tools, such as a tool with a Phillips head, a hex head, an Allen head or a socket head, just to name a few possibilities. The end 66 of the shaft 62 can further include one or more protrusions (not shown) for engagement by a wrench or pliers. It will be understood that the above-described possibilities for the end 66 of the shaft 62 are merely examples, and embodiments of the invention are not limited to any specific configuration.

It should be noted that a locking member can be associated with the cam 43 and/or plate 42 so as to prevent unwanted movement of the shaft 62 and/or cam body 44. In one embodiment, the locking member can be disposed in between the cam body 44 and the plate 42. As an example, the locking member can be a lock washer 70, nordlock washer, or star washer. The cam body 44 can be turned such that the lock washer 70 is compressed and engaged between the cam body 44 and the plate 42, thereby preventing or at least impeding undesired travel of the shaft 62 and/or cam body 44. It will be appreciated that any of a number of devices can serve as the locking member so long as it can at least impede undesired travel or rotation of the shaft 62 and/or cam body 44.

Having described the individual components of an axial locking system 40 according to the invention, certain features of the turbine components that cooperate with the system cooperates will now be described. An axial locking system 40 according to the invention can engage the disc 22 and one or more turbine blades 11. The disc 22 can be configured to receive a portion of the plate 42. For example, the disc 22 can include a recess 72 for receiving the radially inner 52 end of the plate 42. Further, a portion of the disc 22 can engage the cam body 44, as will be described in more detail later. The blades 11 can be configured to engage the plate 42. For instance, the blade platform 20 can include a slot 18 for receiving at least the radially outer end 50 of the plate 42.

As is known, the disc 22 is configured to matingly receive the root portion 74 of each blade 11 provided on the disc 22. When a blade 11 is received in the disc 22, a passage 76 can be formed between the end of the blade root 74 and the disc 22. The passage 76 can extend substantially axially from the axially upstream side 78 of the disc 22 and blades 11 to the axially downstream side 80 of the disc 22 and blades 11. The passage 76 can be open at both of its ends 82. Naturally, the exact geometry of the passage 76 will vary depending on the shape and configuration of the disc 22 and the blade root 74. Ideally, the passage 76 is sized to allow an elongated tool 84, such as a screwdriver, wrench or pliers, to pass therethrough.

The location, shape and size of the passage 76 can dictate the positioning of the cam 43 on the plate 42. According to embodiments of the invention, a user has the ability to access the cam 43 from the opposite side of the disc 22 through the passage 76. In the context of the above described system of a cam 43 with a cam body 44 and a cam shaft 62, the user must be able to access the end 66 of the shaft 62 through the passage 76 so as to remotely manipulate the cam body 44. To that end, a sufficient portion of the end of the shaft 62 is within the open end 82 of the passage 76 for all travel positions of the end 66 of the shaft 62. "Sufficient portion" is intended to mean that enough of the end 66 of the shaft 62 is within the open end 82 of the passage 76 such that a tool 84 inserted in the passage 76 can engage enough of the end 66 of the shaft 62 to turn the shaft 62. "All travel positions of the end of the shaft" is intended to mean all movement of the end 66 of the shaft 62 relative to and with the plate 42 or otherwise. In other words, the range of motion and the location of the shaft 62 and cam body 44 can be limited by the ability of a person to access a sufficient portion of the end 66 of the shaft 62 through the passage 76.

Figure 6A:
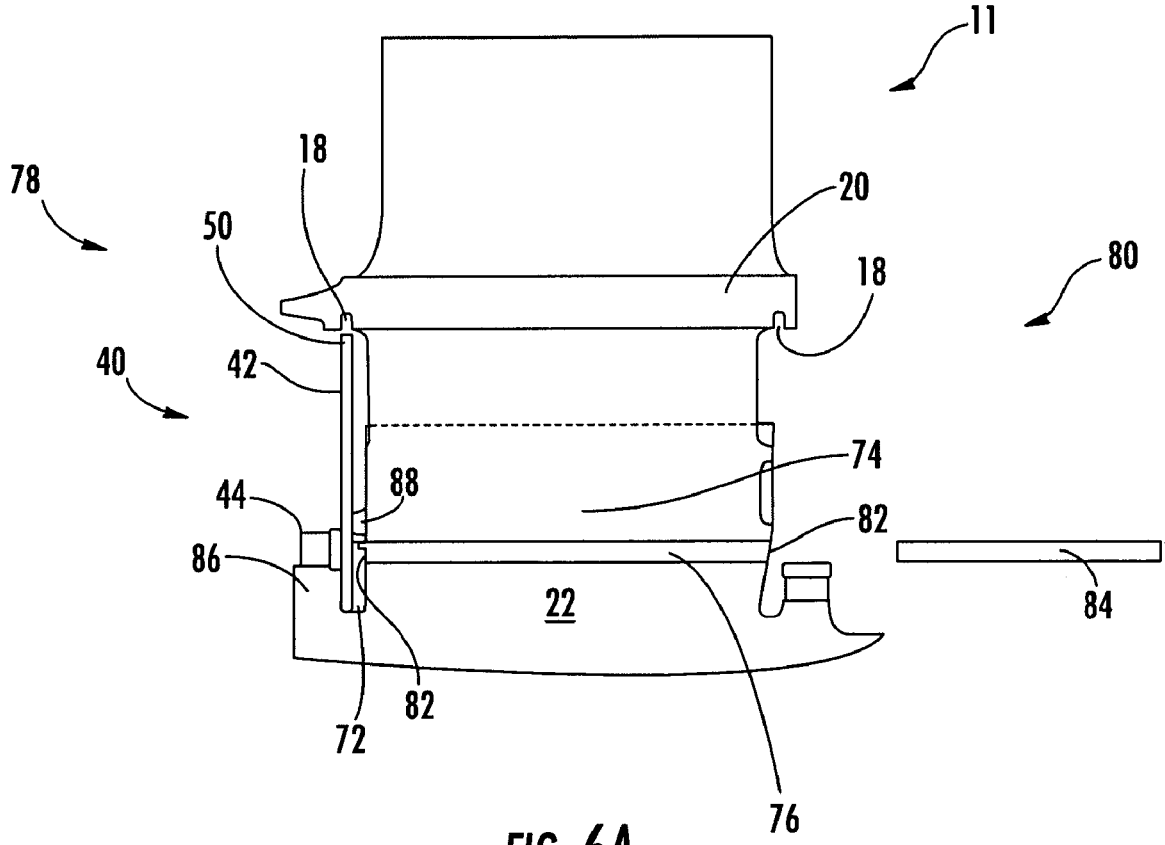
FIG. 6A is a cross-sectional view of a row of turbine blades having an axial locking system according to embodiments of the invention, showing the locking system in the unlocked position.

Generally, the cam 43 can facilitate movement of the locking system 40 between a locked position and an unlocked position. FIG. 6A shows the locking system 40 in the unlocked position in which the plate 42 is disengaged from the platform slot 18 in blade 11. In the unlocked position, the rounded portion 56 of the cam body 44 can engage a portion of the disc 22, such as a protrusion 86. The radially inner end 52 of the plate 42 can be disposed within the channel 72 formed in the disc 22. The radially outer end 50 of the plate 42 may not be in engagement with any other component, but it can be substantially aligned with a slot 18 provided in the blade platform 20. The blade root 74 can include a protrusion 88 for positioning the inside face 46 of the plate 42 substantially alignment with the slot 18 in the blade platform 20.

Figure 3:
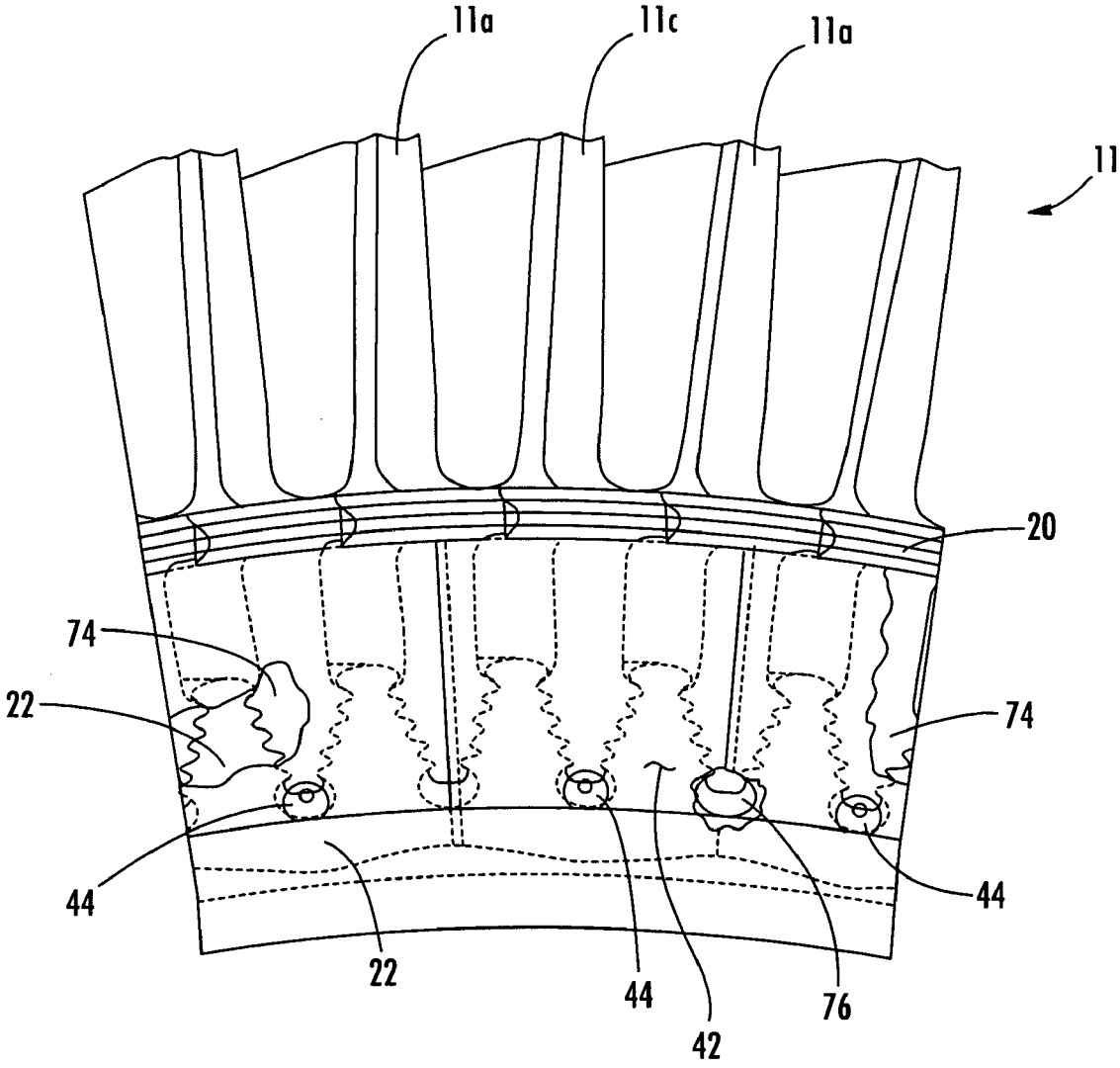
FIG. 3 is a front view of part of a row of turbine blades having an axial upstream locking system according to embodiments of the invention.
Figure 6B:
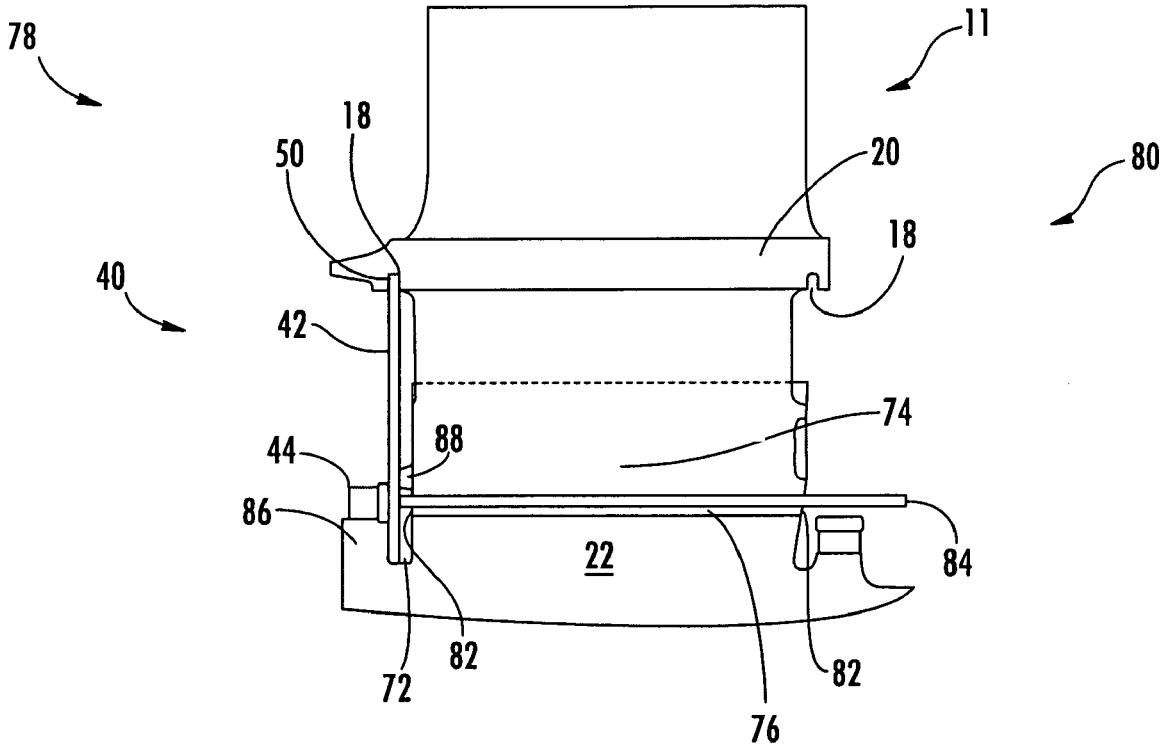
FIG. 6B is a cross-sectional view of a row of turbine blades having an axial locking system according to embodiments of the invention, showing the locking system in the locked position.

The plate 42 can be moved into the locked position, shown in FIG. 6B, in which the plate 42 lockingly engages the blade 11. Movement of the plate into the locked position can be achieved by rotating the cam body 44 with the tool 84. In the locked position, Referring to FIG. 6B, the cam is rotated about 180 degrees from where it is shown in FIG. 6A. In such case, the flat portion 58 of the cam body 44 can engage the disc 22. Again, the rotational axis 60 of the cam body 44 is offset such that the rounded portion 56 of the cam body 44 is located closer to the axis of rotation 60 than the flat portion 58. Thus, as the flat portion 58 engages the disc 22, such as the protrusion 86, the cam body 44 will be pushed radially outward. Because the cam body 44 is connected to the plate 42, the radially outward movement of the cam body 44 is transmitted to the plate 42 as well. Thus, the radially outward end 50 of the plate 42 is lifted into the slot 18 in the blade platform 20. It should be noted that the radially outer end 50 of the plate 42 may only interact with a single blade 11 or with more than one blade 11. For example, as shown in FIG. 3, the radially outer end 50 of one plate 42 engages the platform 20 of three adjacent blades 11. As shown, the plate 42 fully engages the platform of the central blade 11*c* while engaging only a portion of the platform of the adjacent blades 11*a*. Embodiments of the invention are not limited to any specific arrangement in this regard.

The plate 42 can be held in the locked position by the engagement of the plate 42 with the blade platform 20 and by the engagement of the flat portion 58 of the cam body 44 and the disc 22. Further, when the cam body 44 is rotated into the locked position, the cam body 44 can tighten against the locking member between the cam body 44 and the plate 42 so as to prevent undesired motion of the cam body 44 and/or shaft 62. During engine operation, the disc 22 and blades 11 thereon are rotating, and the rotational forces can further help to push the plate 42 radially outward into engagement with the slot 18 in the blade platform 20. In such case, the cam body 44 may not even touch the disc 22 such that the axial locking system 40 is completely unloaded during normal engine operation.

Figure 1:
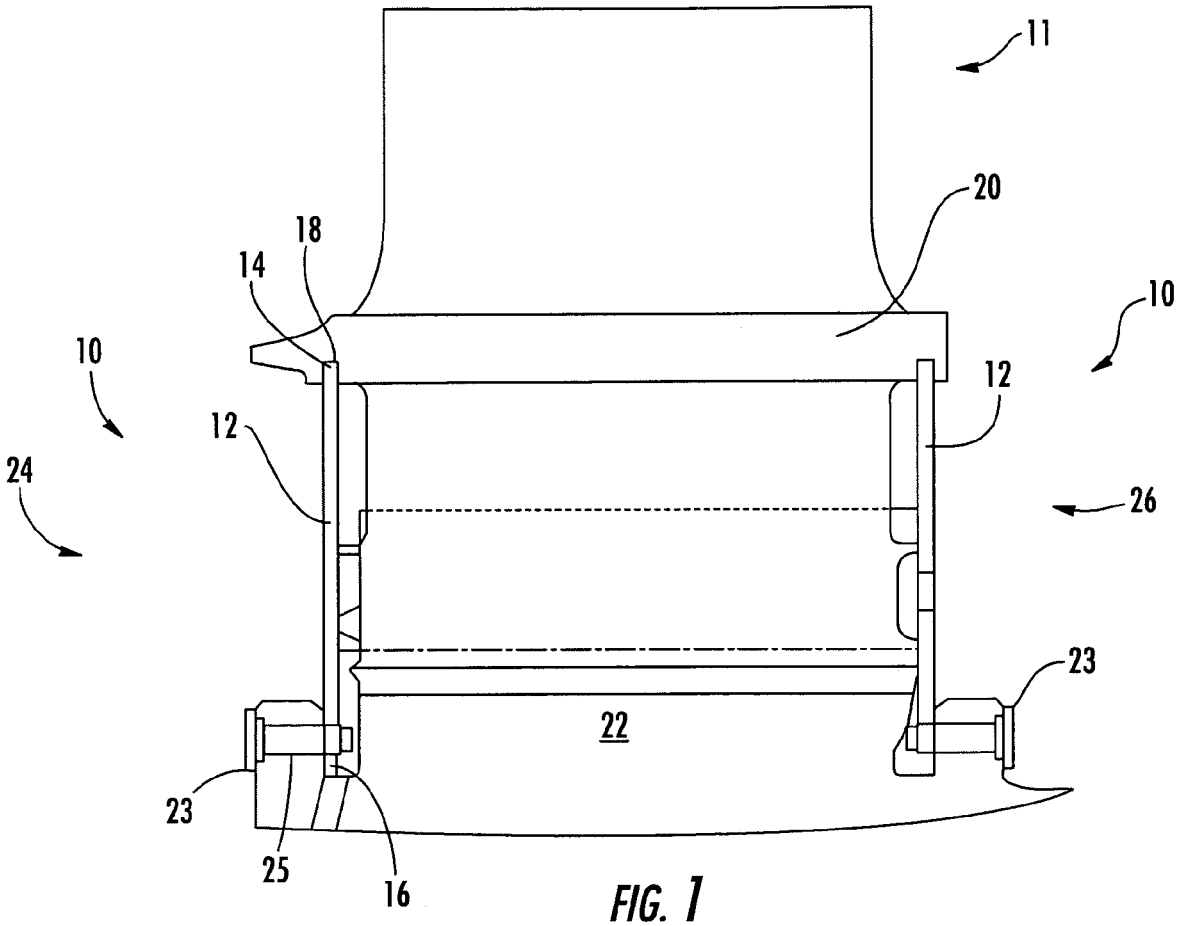
FIG. 1 (PRIOR ART)
FIG. 1 is a cross-sectional view of a prior axial locking system.

Embodiments of the invention are not only well suited for new engine designs, but they are also well suited for retrofit on existing engines. An axial locking system 40 according to embodiments of the invention can be substituted for the prior axial locking system 10, such as the one shown in FIG. 1. There would be no need for modifications to the rotor disc 22 or to any of the blades 11. Because bolts 23 or other fasteners would no longer be used to secure the plate 12 directly to the disc 22, there may be a hole 25 (FIG. 2) remaining in the disc 22 where the bolts 23 used to pass. It may not be necessary to plug the leftover hole 25 because the hole 25 would be covered by the plate 42 according to the invention when the plate 42 is in the locked position, as shown in FIG. 2.

As noted earlier, a plurality of plates 42 can extend about each side of the disc 22. A locking plate 42 according to the invention can be used in combination with other locking plates 42 according to embodiment of the invention. Alternatively, the locking plate 42 according to the invention can be used in combination with the known locking plates, such as the plate 12 shown in FIG. 1.

An axial locking system according to embodiments of the invention can provide advantages over prior locking systems in the art, particularly during the installation and removal of turbine blades. One example of removing turbine blades that are axially restrained with an axial locking system according to embodiments of the invention will now be explained. For purposes of convenience, this example will be discussed in connection with the last row of blades in the turbine. Further, the example will be directed to a system in which the axial upstream side 78 of the disc 22 includes an axial locking system according to the invention and the axial downstream side 80 of the disc 22 includes a prior axial locking system, as shown in FIG. 2. It will be understood that embodiments of the invention are not to be limited in any way by this example.

Figure 5:
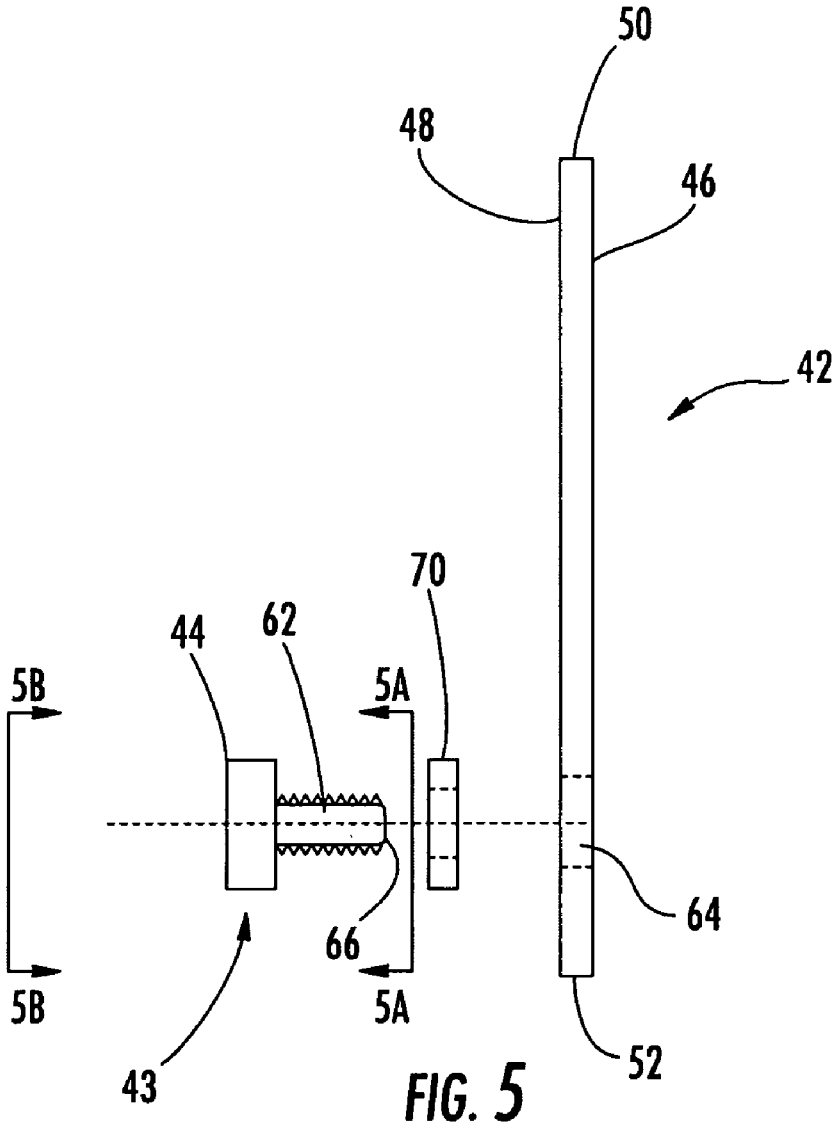
FIG. 5 is a side elevational exploded view of an axial locking plate assembly according to embodiments of the invention.
Figure 5A:
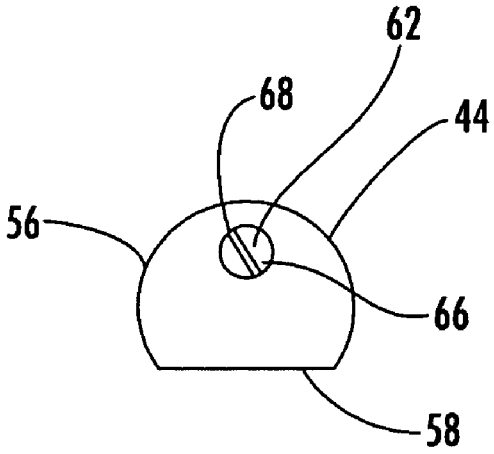
FIG. 5A is a rear elevational view of a cam according to embodiments of the invention, taken along line 5A-5A in FIG. 5, showing a slot provided on the end of the shaft connected to the cam.
Figure 5B:
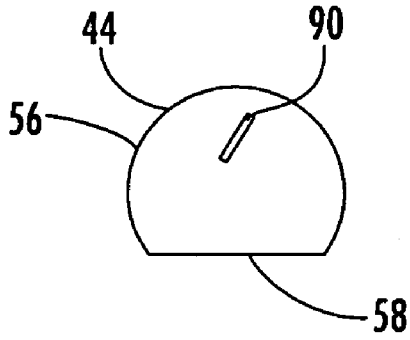
FIG. 5B is a front elevational view of a cam according to embodiments of the invention, taken along line 5B-5B in FIG. 5, showing a slot provided on the cam.

The axial locking system on the downstream side 80 of the last row of blades can be accessed through the engine exhaust (not shown). The bolt 23 securing the plate 12 to the disc 22 can be removed, then the plate 12 can be simply removed through the exhaust. In order to remove the blade 11, the locking system 40 on the axial upstream side 78 of the disc 22 must be removed. Referring to FIGS. 6A and 6B, a tool 84 can be inserted into the passage 76 and into engagement with the end 66 of the shaft 62. Assuming the end 66 of the shaft 62 provides a slot 68 (FIG. 5A), the slot 68 can be engaged by a screwdriver. Embodiments of the invention are not limited to any specific tool 84 for engaging the end 66 of the shaft 62. If, for instance, the end 66 of the shaft 62 is configured with a Phillips head recess, the tool 84 for engaging the end 66 of the shaft 62 is not limited to a Phillips screwdriver. Thus, the tool 84 can be one that is specifically configured for the end 66 of the shaft 62, or it can be any kind of tool 84 so long as it can turn the shaft 62 and the cam body 44.

The tool 84 can be turned so as to turn the cam body 44 into the unlocked position such that the radially outer end 50 of the plate 42 disengages the slot 18 in the blade platform 20. Then, the blade 11 can be removed through the engine exhaust by pulling axially rearward on the blade 11. During the removal of the blade 11, the plate 42 can be held in place by its engagement with the adjacent plates 42. With the blade 11 removed, a user can simply reach in the space where the blade 11 once was to remove the plate 42, or the plate 42 can remain. It will now be appreciated that the need to remove the outer casing and vane carrier has been bypassed, resulting in significant cost savings.

The above process can be repeated for each axial locking system 40. If an entire row of blades 11 is to be removed, then mention should be made of a precaution that should be taken during the removal of the last or the last few plates 42. For example, if there is only a single plate 42 remaining, the plate 42 can fall into the turbine when the cam body 44 is moved into the unlocked position because the plate 42 is no longer supported at its peripheral ends 54 by adjacent plates. Recovery of the fallen plate 42 may be difficult and can increase costs dramatically. Thus, when coming to the last plate 42 or last few plates 42, a user should hold the plate 42 in place so it does not fall out as it is moved to the unlocked position. With most of the blades 11 and plates 42 removed, there should be plenty of room for a person to reach around to the axial upstream side 78 of the disc 22 to grab the plate 42.

As noted earlier, the plate 42 can engage more than one blade 11. For example, as shown in FIG. 3, the radially outer end 50 of the plate 42 engages three adjacent blades 11. As shown, the plate 42 fully engages the platform 20 of a central blade 11*c* whereas the plate 42 only engages a part of the platform 20 in the adjacent blades 11*a*. In such case, it should be noted that the removal of the plate 42 may only permit removal of the central blade 11*c*. It may be necessary to remove the adjacent plates 42*a* to allow removal of the other blades 11*a*.

Not only can an axial locking system 40 according to the invention facilitate removal of turbine blades, but it can also facilitate the installation of turbine blades. The discussion will continue using the example of the last row of blades. At the outset, it will be assumed that there are no blades in place. It will also be assumed that one plate engages three blades as discussed above. Thus, an installer can insert three blades 11. The installer can reach around and position the plate 42 axially upstream of the three blades 11. Holding the plate 42 in place, a tool 84 can be inserted into the passage 76 and into engagement with the end 66 of the shaft 62. The cam body 44 can be turned by the tool 84. Once the plate 42 is moved into the locked position, the plate 42 can be released by whatever is holding it in place. The same steps can be repeated for the rest of the blades 11 in the row. For subsequent blades 11, it may a possible to insert the plate 42 prior to inserting the blades 11 associated with that plate 42. Further, it may not be necessary to hold the plate 42 in place because the peripheral ends 54 of the plate 42 can engage the peripheral end of an adjacent plate.

While embodiments of the invention have been explained above in connection with the final row of blades, embodiments of the invention can readily be applied to other rows of blades. For example, embodiments of the invention can be applied to any intermediate rows of blades, which includes any row of blades other than the first and last rows of blades. Unlike the last row of blades, the intermediate rows cannot be accessed from the turbine exhaust. While access to the intermediate rows of blades may require removal of the outer casing and vane carrier, there may be situations where it may be beneficial to provide an axial locking system according to the invention on the intermediate rows of blades. For instance, the turbine outer casing and a vane carrier dedicated to a single row of blades may be removed to service one of the intermediate row of blades. While servicing this row of blades, it may be discovered that the upstream row of blades is damaged. As will be appreciated, embodiments of the invention can facilitate the removal of one or more of these upstream blades without removing the vane carrier associated with this upstream row of blades, thereby providing time and labor savings.

Further, embodiments of the invention are not limited to being provided on the axial upstream side 78 of a row of blades 11 to permit withdrawal of the blades 11 from the axial downstream side 80. For instance, the axial upstream side 78 of first row of blades 11 may be accessible through the combustor section of the engine (not shown), but the axial downstream side 80 may not be readily accessible. In such case, an axial locking system 40 according to the invention can be provided on the axial downstream side 80 of the first row of blades 11. Thus, in the manner described above, the locking system 40 can be remotely manipulated from the axial upstream side 78 of the blades 11.

A locking system 40 according to the invention can be provided on both the axial upstream side 78 and the axial downstream side 80 of the disc 22. Such an arrangement is particularly suited for those rows of blades 11 for which access is available including, for example, the upstream side of the first row of blades or the downstream side of the last row of blades. In such case, the cam 43 can be manipulated from the outside face 48 of the plate 42. There are a number of ways such manipulation can be achieved according to embodiments of the invention. For instance, the cam body 44 can provide one or more protrusions (not shown) for being engaged by a hand or a tool, such as pliers or a wrench. Alternatively, at least a portion of the cam body 44 can be knurled or have some other surface finish to facilitate engagement by a tool. In one embodiment, shown in FIG. 5A, the cam body 44 can provide a slot 90 for engagement by a tool, such as a flat head screwdriver. The cam body 44 can also provide a recess configured for other headed screwdrivers (Phillips, hex, Allen, socket, etc.) or other tools. It will be understood that the above-described possibilities for the are merely examples, and embodiments of the invention are not limited to any specific configuration.

The foregoing description is provided in the context of one possible axial locking system for turbine blades. Though described in the context of the turbine section, embodiments of the invention can be applied to other portions of the engine, including in the compressor section, as one skilled in the art will appreciate. Thus, it will of course be understood that the invention is not limited to the specific details described herein, which are given by way of example only, and that various modifications and alterations are possible within the scope of the invention as defined in the following claims.

What is claimed is:

1. A locking plate assembly for axially restraining a turbine component comprising:

a turbine blade;

a plate having a first side and a second side, wherein an opening extends through the plate from the first side to the second side;

a cam including a cam body and a cam shaft extending from the cam body, the cam body being disposed on the first side of the plate, the cam body being rotatably connected to the plate by engagement between the cam shaft and the opening, the cam shaft defining an axis of rotation of the cam body that is offset from the center of the cam body, a portion of the cam being accessible from the second side of the plate, wherein the accessible portion of the cam is adapted for engagement by a tool, wherein turning of the accessible portion of the cam causes the cam body to rotate about the axis of rotation; and a locking member disposed between the cam body and the plate, whereby the locking member impedes undesired movement of the cam.

2. The assembly of claim 1 wherein the opening in the plate is threaded and the cam shaft is threaded, wherein the cam body is rotataby connected to the plate by threaded engagement between the cam shaft and the opening.

3. The assembly of claim 1 wherein the cam shaft extends from the cam body to an end, wherein the end of the cam shaft is the accessible portion of the cam.

4. The assembly of claim 1 wherein the accessible portion of the cam includes one of a flat head slot, a Phillips head recess, a socket head recess, a hex head recess, an Allen head recess, and a protrusion.

5. A turbine blade axial locking system comprising:

a turbine blade;

a disc having an axial upstream side and an axial downstream side, the disc being adapted for receiving at least a portion of the turbine blade such that a substantially axial passage is formed between the blade and the disc, the passage being open at both ends; and a plate having an inner face and an outer face, the plate positioned on one side of the disc such that the inner face of the plate faces the disc;

a cam including a cam body provided on the outer face of the plate, the cam body being rotatably connected to the plate, the cam body having an axis of rotation that is offset from the center of the cam body, the cam body engaging a portion of the disc such that the plate is movable into and out of locking engagement with the blade, wherein, for all travel positions of the cam body, a sufficient portion of the cam is accessible from the inner face of the plate within an area defined by superimposing the passage onto the inner face of the plate, whereby an elongated tool inserted into the passage from the side of the disc opposite the side on which the plate is positioned can engage the sufficient portion of the cam so as to rotate the cam body.

6. The system of claim 5 further including a locking member disposed between the plate and the cam body, whereby unwanted movement of the cam is substantially impeded by the locking member.

7. The assembly of claim 5 wherein the cam body includes a rounded portion and a flat portion, wherein the axis of rotation of the cam body is located closer to the rounded portion than the flat portion of the cam body.

8. The system of claim 5 wherein the blade includes at least a platform portion and a root portion, wherein the plate lockingly engages the platform portion of the blade.

9. The system of claim 8 wherein the platform portion provides a slot for receiving the plate.

10. The system of claim 5 wherein the accessible portion of the cam is adapted for engagement by a tool.

11. The system of claim 5 wherein the accessible portion of the cam includes one of a flat head slot, a Phillips head recess, a socket head recess, a hex head recess, an Allen head recess, and a protrusion.

12. The system of claim 5 wherein the plate includes a threaded opening extending between the outer face and the inner face of the plate, and wherein a threaded cam shaft extends from the cam body and into threaded engagement with the threaded opening, whereby the cam body rotates relative to the plate by threaded engagement between the cam shaft and the opening.

13. The system of claim 12 wherein the cam shaft extends from the cam body to an end, wherein the end of the cam shaft is accessible from the inner face of the plate.

14. The system of claim 13 wherein the end of the cam shaft is adapted for engagement by a tool.

15. The system of claim 5 wherein, when the plate lockingly engages the blade, a portion of the opposite end of the plate abuts a portion of the disc.

16. A method of accessing turbine blades comprising:

providing a turbine blade and a disc, the disc having an axial upstream side and an axial downstream side, the disc being adapted for receiving at least a portion of the turbine blade such that a substantially axial passage is formed between the blade and the disc;

providing a plate having an inner face and an outer face, the plate positioned on one side of the disc such that the inner face of the plate faces the disc, providing a cam including a cam body disposed on the outer face of the plate, the cam body being rotatably connected to the plate, the cam body having an axis of rotation that is offset from the center of the cam body, the cam body engaging a portion of the disc such that the plate is movable into and out of locking engagement with the blade, wherein, for all travel positions of the cam body, a sufficient portion of the cam is accessible from the inner face of the plate within an area defined by superimposing the passage onto the inner face of the plate;

inserting an elongated tool into the passage from the side of the disc opposite the side on which the plate is positioned; and engaging the accessible portion of the cam with the tool.

17. The method of claim 16 further including the step of rotating the cam body with the tool so as to move the plate into locking engagement with the blade.

18. The method of claim 16 further including the step of rotating the cam body with the tool so as to move the plate out of locking engagement with the blade.

19. The method of claim 18 further including the step of holding the plate during the step of rotating the cam body.

20. The method of claim 18 further including the step of removing the blade by moving the blade axially toward the side of the disc opposite the side on which the plate is positioned.

21. The assembly of claim 1, wherein rotating the accessible portion of the cam causes the plate to translate in a radial direction.

* * * * *